US006779345B2

(12) United States Patent
Girouard

(10) Patent No.: US 6,779,345 B2
(45) Date of Patent: Aug. 24, 2004

(54) SYSTEM AND METHOD FOR ESTIMATING PERFORMANCE OF A CLOSED CYCLE THERMAL PROPULSION SYSTEM

(75) Inventor: William A. Girouard, South Dartmouth, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 45 days.

(21) Appl. No.: 10/175,536

(22) Filed: Jun. 19, 2002

(65) Prior Publication Data

US 2003/0233829 A1 Dec. 25, 2003

(51) Int. Cl.[7] ..... F01K 13/02

(52) U.S. Cl. ..... 60/646; 60/657

(58) Field of Search ..... 60/646, 657

(56) References Cited

U.S. PATENT DOCUMENTS 5,117,635 A * 6/1992 Blau ..... 60/668
5,131,231 A * 7/1992 Trimble et al. ..... 60/649
5,233,823 A * 8/1993 Day ..... 60/775

* cited by examiner

*Primary Examiner*—Hoang Nguyen
(74) *Attorney, Agent, or Firm*—James M. Kasischke; Michael F. Oglo; Jean-Paul A. Nasser

(57) ABSTRACT

The present invention permits determination of steady-state off-design performance characteristics of a vehicle, such as a torpedo, powered by a closed cycle thermal propulsion system. The method may be utilized to determine propellant consumption for a torpedo resulting from various off-design kinematic maneuvers. Total run time may be calculated in response to a plurality of torpedo speed changes and/or torpedo configurations of variable torpedo length or torpedo diameter. The present invention may be utilized to define weapon design options for existing or future underwater weapons with mission requirements different from those for which the weapons were originally designed.

6 Claims, 4 Drawing Sheets

SYSTEM AND METHOD FOR ESTIMATING PERFORMANCE OF A CLOSED CYCLE THERMAL PROPULSION SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATION

Not applicable.

BACKGROUND OF THE INVENTION (1) Field of the Invention

The present invention relates generally to systems and methods for closed cycle thermal propulsion systems and, more particularly, to methodology for estimating performance, including off-design performance, for closed cycle thermal propulsion system.

(2) Description of the Prior Art

Closed cycle thermal propulsion systems are well known and may often be utilized to propel torpedoes through the water. Generally, design parameters for the propulsion systems of torpedoes are based on assumptions such as, for instance, anticipated torpedo speed and range as well as the anticipated torpedo length and diameter. Prior to the present invention, there was no available means to determine how the torpedo would perform based on off-design criteria, e.g., if various kinematic maneuvers were made, different speeds utilized, different torpedo lengths and diameters were used, and so forth. Such capability may be of particular use for special mission requirements that may utilize existing equipment.

Various inventors have attempted to solve related problems as evidenced by the following patents, without providing the solutions taught hereinafter.

U.S. Pat. No. 5,291,390, issued Mar. 1, 1994, to Nobuyasu Satou, discloses a control apparatus for a mechanical device including a control element for receiving a reference input signal and supplying an operating signal to the mechanical device, a main feedback element for detecting the control signal and supplying the detected control signal to the control element, and an auxiliary feedback element for detecting the operating signal to be supplied to the mechanical element and supplying the detected operating signal to the control element. The control element produces the operating signal based on the reference input signal, the control signal supplied from the main feedback element, and the operating signal supplied from the auxiliary feedback element to regulate the control speed such that hunting in the control apparatus does not occur.

U.S. Pat. No. 5,117,635, issued Jun. 2, 1992, to Alfred Blau, discloses a unique arrangement of components comprising an open Rankine cycle power system for underwater application. The arrangement features a high energy density steam generator, a turbine, pumps and other apparatus to provide and control the flow of a seawater working fluid and the use of a mixing condenser the spent steam. The mixing condenser uses droplets of seawater to condense the steam exhausted from the turbine. Alternatively, the steam may be introduced into a pool of water in the mixing condenser by means of a bubble device. The mixing condenser also provides a preheated feedwater supply for the boiler. This system facilities the packaging of power sources an order of magnitude more powerful than current sources. Moreover, this system can be installed in current vehicles.

U.S. Pat. No. 4,991,530, issued Feb. 12, 1991, to Alan D. Rathsam, discloses a fin apparatus for controlling heat flux distributions in a heated body, such as a torpedo. The torpedo may have inner and outer spaced apart shells with a predetermined ratio of conducting and nonconducting fins affixed to the shells in the space there between. In a torpedo it is desirable to establish the ratio so that heat will be distributed form the outer skin of the torpedo shell to improve laminar stability in the boundary layer as the torpedo travels through the water.

U.S. Pat. No. 4,846,112, issued Jul. 11, 1989, to Buford et al., discloses an ullage compensator for a stored chemical energy power propulsion system. With the invention, at least one moveable wall is provided within a reactor having a chamber which is moveable between a first position at which the chamber has a maximum reaction volume to a second position at which the reaction chamber has a minimum volume. A force is applied to the moveable wall by a bellows to cause the wall to project into the chamber in response to the force when a reaction is occurring within the chamber. The invention eliminates damage to the interior surface of the chamber and the inlet port(s) for introducing an oxidant into the chamber with sustains the reaction caused by direct contact with a gaseous oxidant which causes the reaction.

U.S. Pat. No. 4,680,934, issued Jul. 21, 1987, to Keith E. Short, discloses a construction including a housing having an interior wall, defining a chamber with at least one oxidant inlet, in which weight, noise and response difficulties in boilers utilized in torpedoes are eliminated. A pluarality of working fluid conduits each have an inlet and an outlet exterior of the housing and heat exchange section within the chamber. Each heat exchange section is a plural convolution coil and the individual convolutions of each conduit are interleaved with the individual convolutions of the other conduits. Valves control the flow of working fluid through at least some of the conduits independently of the others.

U.S. Pat. No. 4,658,589, issued Apr. 21, 1987, to Thomas A. Sutrina, discloses an ejection system including a steam ejector having a steam nozzle aligned with a diffuser which defines an outlet from the ejection system. The ejector has an inlet to the interface of the nozzle and the diffuser. A normally closed, non-condensable flow control valve has an outlet connected to the ejector inlet and an inlet adapted to be connected to a working fluid flow path of a Rankine cycle apparatus. A motor is provided for selectively operating the flow control valve. A steam generating reaction chamber is in fluid communication with the steam nozzle and first and second pressure vessels are provided and adapted to contain a different reaction. A valve controls fluid communication between the pressure vessels and the reaction chamber.

U.S. Pat. No. 4,637,213, issued Jan. 20, 1987, to Lobell et al., discloses an arrangement for a thermal, steam-powered engine in a submarine vehicle, for example a torpedo. A condenser is so arranged as to separate the exhaust from the engine into a condensable exhaust fraction and into a non-condensable exhaust fraction. A compressor, which is connected to the engine for the purpose of silencing, is so arranged as to compress only the non-condensable exhaust fraction which, after compression is discharged through an exhaust outlet into the surrounding sea water. The condenser is in the form of a sleeve which for silencing purpose encloses both the engine and the compressor. A sound-deadening gap is arranged between the condenser and the hull of the vehicle.

U.S. Pat. No. 4,598,552, issued Jul. 8, 1986, to Kent Weber, discloses an energy source for a closed cycle engine including a boiler having a working fluid chamber in heat exchange relation with a reaction chamber. A closed flow path loop including a turbine receives working fluid from the fluid chamber, provides a power output and returns the fluid to the chamber. Lithium is reacted with water in the reaction chamber to generate heat for heating the working fluid and hydrogen. Oxygen, obtained by decomposition of sodium superoxide elsewhere in the system, is fed to the reaction chamber and combined with the hydrogen to provide water and additional heat for the working fluid.

U.S. Pat. No. 4,597,345, issued Jul. 1, 1986, to Resser et al., discloses a communications link between a submarine and a torpedo secured within launch tube flooded with seawater. A transmit/receive light beam pair propagating through the water provides the high bandwidth data channels between the tube wall and the adjacent torpedo hull for two-way communication.

The above patents do not disclose a method for estimating off-design operating parameters including steady state operating characteristics for closed cycle thermal propulsion systems. For instance, the above patents do not teach determining propellant consumption for a torpedo as a result of various kinematic maneuvers. As another example, the above patents do not teach how to estimate total torpedo run time if the torpedo speeds, lengths, diameter, and so forth are altered from the original design. Consequently, there remains a long felt but unsolved need for improved determination of torpedo characteristics that may be utilized to define weapon design options in fulfill future mission effectiveness requirements. Those skilled in the art will appreciate the present invention that addresses the above and other problems.

SUMMARY OF THE INVENTION

Accordingly, it is an objective of the present invention to provide an improved system and method for determining performance characteristics of propulsion systems.

Another objective is to provide a system and method as aforesaid which may be utilized to determine off-design characteristics of a closed cycle thermal propulsion system.

A further objective is to provide a system and method as aforesaid whereby propellant consumption for a torpedo may be determined as a result of various kinematic maneuvers.

These and other objectives, features, and advantages of the present invention will become apparent from the drawings, the descriptions given herein, and the appended claims. However, it will be understood that the above listed objectives and advantages of the invention are intended only as an aid in understanding aspects of the invention, and are not intended to limit the invention in any way, and do not form a comprehensive list of objectives, features, and advantages.

In accordance with the present invention, a system is provided for a method for determining one or more off-design performance characteristics for a closed cycle thermal propulsion system which may comprise one or more steps such as, for instance, providing design characteristics of the closed cycle thermal propulsion system, inputting off-design requirements for the closed cycle thermal propulsion system, and determining the one or more off-design performance characteristics of the closed cycle thermal propulsion system in response to the off-design requirements.

The off-design requirements may comprise one or more legs, or segments of differing speed/time duration profiles, of a route, or run of, a vehicle powered by the closed cycle thermal propulsion system, and providing a speed and time duration for each of the one or more legs wherein the method may comprise determining propellant consumption for the one or more legs. The method may be utilized in the case wherein a different speed is utilized for each of at least two legs. The method may further comprise determining total run time in response to the off-design requirements.

The off-design requirements may also comprise vehicle configurations of different lengths and diameters powered by the closed cycle thermal propulsion system.

In one preferred embodiment, the may further comprise iteratively determining off-design turbine parameters such as parameters related to off-design turbine efficiency. The method may further comprise determining propellant consumption rate at an off-design speed. Moreover, the method may further comprise determining parameters related to steam flow rate at an off-design speed and/or determining the propellant consumption rate for the off-design speed by utilizing the steam flow rate at the off-design speed.

In other words, a method is provided that may comprise one or more steps such as, for instance, providing design characteristics of the closed cycle thermal propulsion system comprising a design for a vehicle powered by the closed cycle thermal propulsion system and/or determining the one or more performance characteristics of the closed cycle thermal propulsion system in response to one or more off-design speeds for the vehicle.

Other steps may comprise determining a turbine working fluid flow rate at the one or more off-design speeds and/or utilizing the turbine working fluid flow rate to determine propellant consumption at the one or more off-design speeds.

Thus, the method may also comprise providing design characteristics of the closed cycle thermal propulsion system, inputting off-design requirements that may comprise one or more legs of a route for a vehicle powered by the closed cycle thermal propulsion system, and providing an off-design speed and a time duration for each of the one or more legs, then determining the one or more off-design performance characteristics of the closed cycle thermal propulsion system in response to the off-design requirements.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein corresponding reference characters indicate corresponding parts throughout several views of the drawings and wherein.

DESCRIPTION OF THE PREFERRED EMBODIMENT

The present invention provides methods for estimating the steady-state off-design performance of a torpedo with a closed cycle thermal propulsion system. The present invention may be used for estimating performance as to the effect of design changes including vehicle configurations of variable length and diameter.

The present may be utilized to calculate propellant consumption for a torpedo resulting from various kinematic maneuvers. Design speed and range can be varied, and the consumption of propellants may be computed for variable vehicular speeds, such as, for instance, off-design speeds down to 35% of design speed. For instance, utilizing the present invention, one can estimate the total run time resulting form various torpedo speed changes and/or other torpedo changes.

Figure 1:
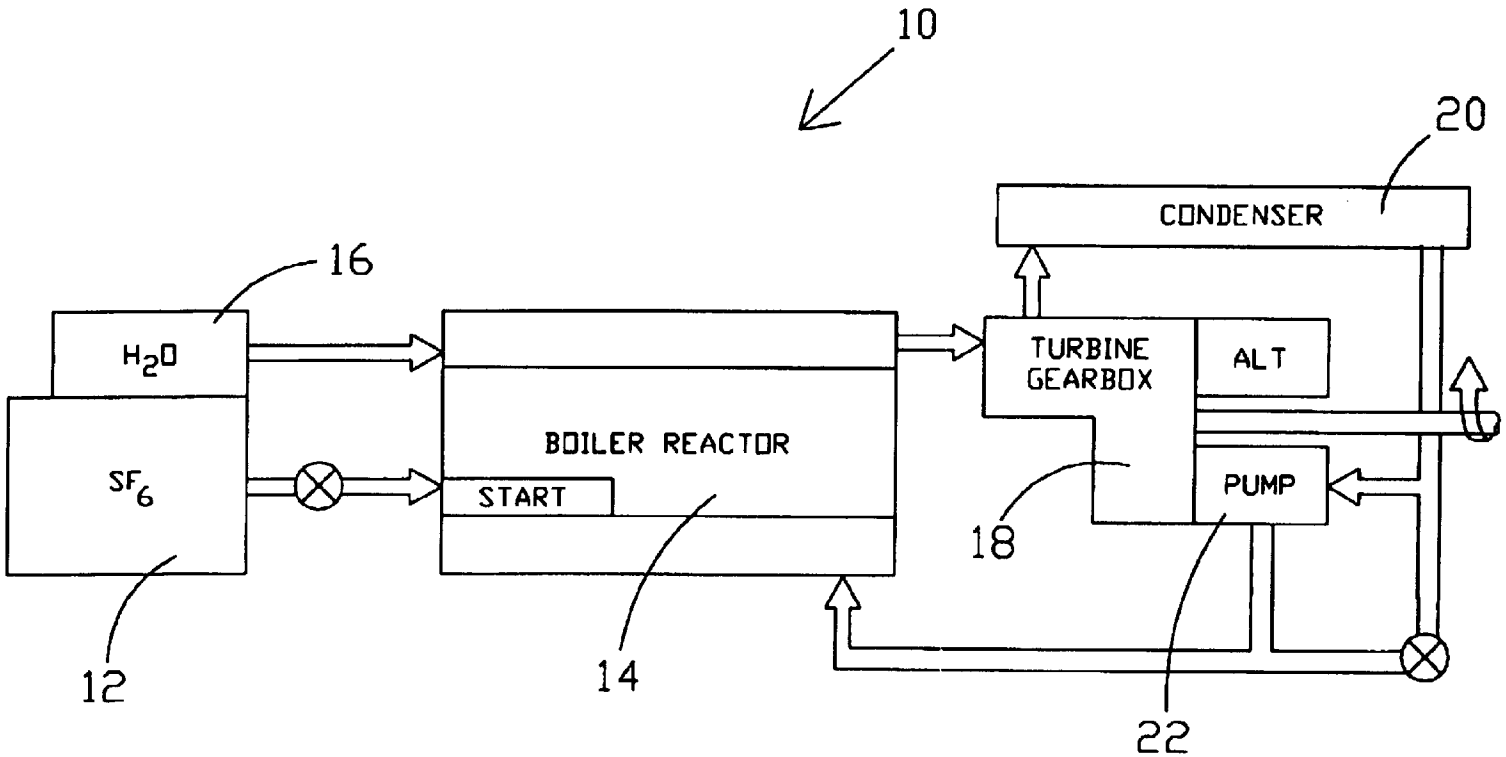
FIG. 1 (PRIOR ART)
FIG. 1 is a block diagram schematic showing a prior art closed cycle thermal propulsion system for which off-design operation characteristics may be determined in accord with the present invention.

Referring now to the figures and, more particularly to FIG. 1, there is shown a block diagram for a prior art closed cycle thermal propulsion system 10 which is similar to that used in a U.S. Navy torpedo. System 10 incorporates the heat of reaction of energy source 12 for a steam Rankine cycle which may utilize sulfur hexafluoride ($SF_6$) and molten lithium, and/or other fuels. The so-produced chemical reaction is contained in boiler 14. Boiler 14 transfer the heat of reaction to working fluid 16. In a preferred embodiment, water may be the system working fluid, although other working fluids could also be utilized. Working fluid 16 absorbs energy as it flows through the tubes and turns to steam. Boiler (reactor) 14 size is determined by the amount of fuel (lithium) needed to generated sufficient energy to satisfy the mission requirement. From boiler 14, the steam proceeds through the turbine prime mover 18 and then flows to hull condenser 20 located in the skin of the torpedo. Condenser 20 consists of a condensing portion and subcooling portion. Each portion consists of longitudinal slots. Heat rejection from condenser 20 passes to the seawater around the torpedo. Upon leaving condenser 20, the flow goes through the feedwater pump 22 for pressurization back to boiler 14.

The present invention may be utilized to determine propellant consumption for a torpedo with a closed cycle thermal propulsion system resulting from various kinematic maneuvers. For instances, the present invention allows one to estimate torpedo endurance for a varying velocity/time profile, e.g., the velocity/time curve 24 shown in FIG. 2.

Figure 2:
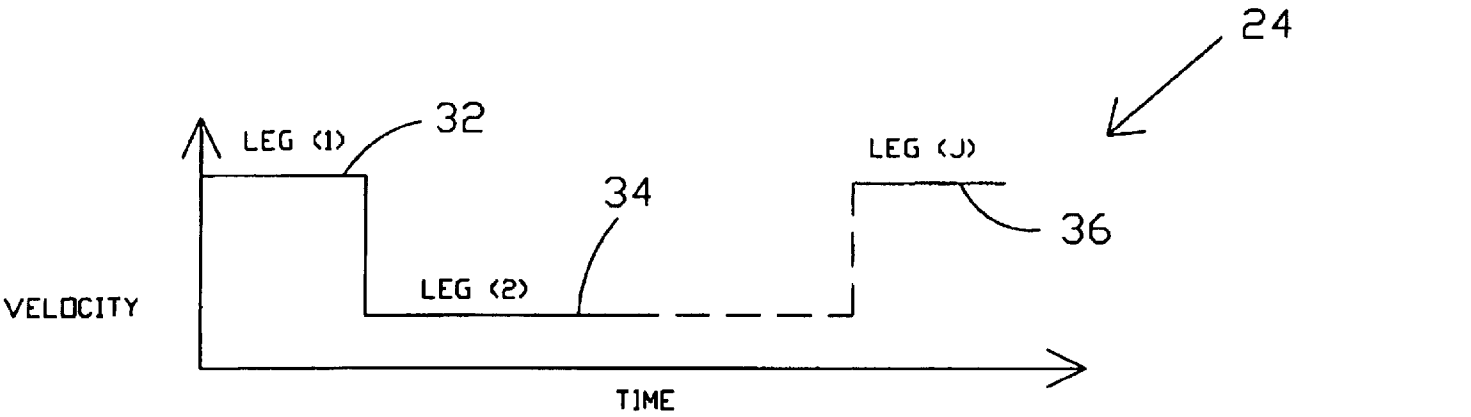
FIG. 2 is a graph that shows a selected velocity versus time for various legs, or segments, of a route taken by a vehicle.
Figure 3:
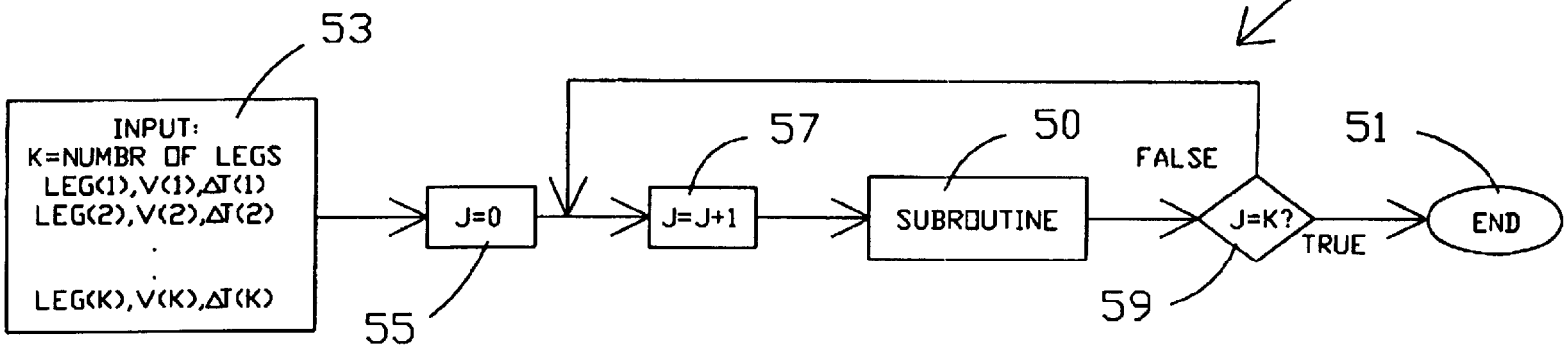
FIG. 3 is a flow chart for a methodology that may utilize the velocity versus time information as shown in FIG. 2 for determining if propellant exhaustion occurs during the route and, should the fuel be exhausted, at which point in the route this occurs.

FIG. 3 provides a flow chart for a main routine 30 which may be utilized for inputting the different velocities and/or different time durations in legs (1), (2), . . . (J), respectively designated curve segments, 32, 34*a* and 36 of the routine as shown in FIG. 2. The present invention therefore permits calculation of the propellant consumption rate based on legs 32, 34 and 36. This permits calculations based upon run times with different time durations of a plurality of legs.

Figure 4A:
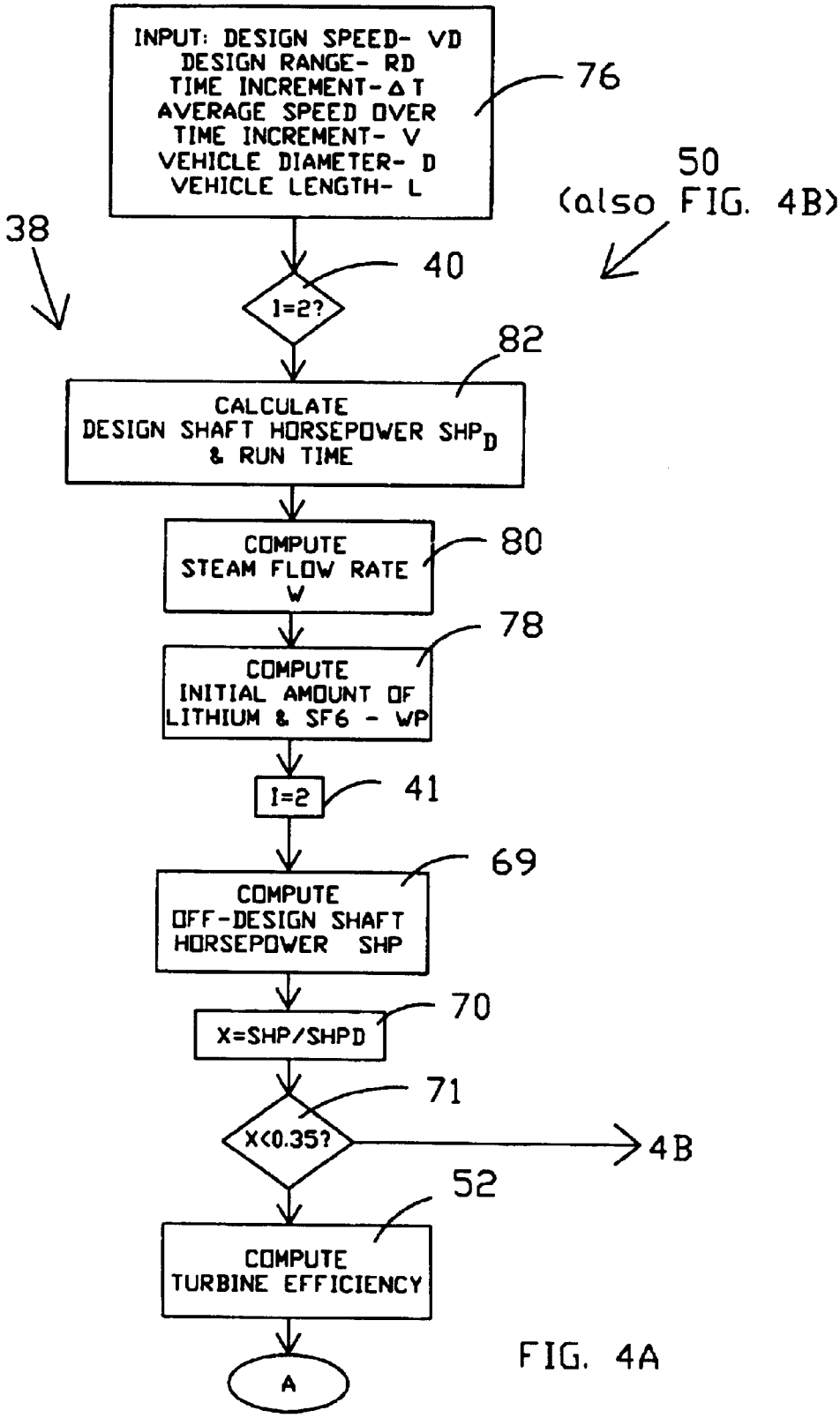
FIGS. 4A and 4B are a flow chart of a preferred subroutine for use in making preferred calculations for each leg of the route analyzed in the method of FIG. 3.
Figure 4B:
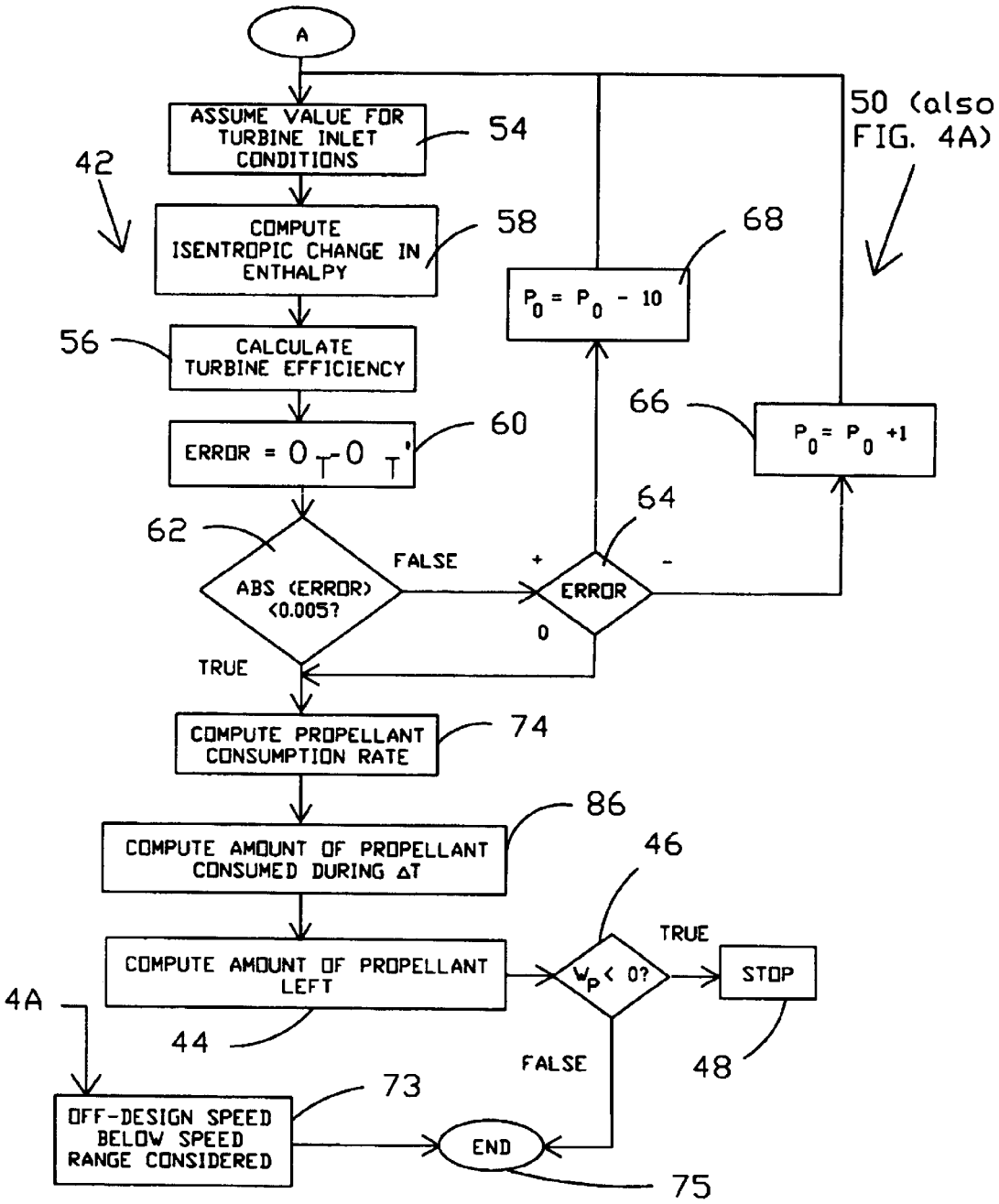

The input requirements preferably include design speed and range, as shown at input box 76 of subroutine 50 of FIGS. 4A and 4B, and also preferably include a predefined time increment used to update the coordinates of the vehicle, the average speed over this time increment, and the length and diameter of the torpedo. The latter two terms are needed to determine the propulsive power requirement at the desired design speed, as discussed hereinafter by calculating the shaft horsepower as indicated by software module 38, comprising steps 78, 80 and 82, which may be calculated by means known in the art. A counting parameter, as indicated at 40 and 41 in subroutine 50, may be used to designate the first time module 38 is called. During operation of module 38, the initial amount of lithium and $SF_6$ are calculated. Thereafter, module 38 may be omitted when subroutine 50 is called from main routine 30 and the amount of lithium and $SF_6$ remaining after the previously investigated leg of the route is utilized.

An iteration process, as indicated at software module 42, is used to compute the inlet turbine pressure within a preferred accuracy, e.g., 5 psia. Subroutine also checks to see if fuel exhaustion occurs during the leg as indicated at 44 and 46. If fuel exhaustion occurs, the program stops, as indicated at 48 in subroutine 50 and 51 in routine 30 (this is what is meant by the END symbol 51 in FIG. 3). Otherwise, program control continues back to the main routine 30 whereupon the present invention continues making the desired estimations for any remaining legs that are left in the torpedo's run profile, e.g., the velocity/time information curve of FIG. 2.

Thus, input to main routine 30 comprises information concerning the various legs as listed at input box 53 of FIG. 3, which may include data such as velocity/time curve 24 information of FIG. 2. Main routine 30 makes computations using subroutine 50 for each leg starting with the first leg counted by program 30 as indicated at 55 and 57, until all legs are computed as indicated at 59, assuming sufficient initial fuel is available so that fuel exhaustion does not occur. If fuel exhaustion does occur, the relative time and/or geographical position within the leg may be determined, if desired. As well, additional fuel requirements could be determined and/or other information may be provided.

Subroutine 50 of the present invention is utilized to make turbine efficiency estimates beginning at module starting point 52 when utilizing module 42. Particulars of a preferred embodiment of the invention are provided as follows:

For variable speed operation, the efficiency of the prime mover (assumed to be a turbine) has to be determined as a function of vehicular speed. The following expressions are used to obtain partial admission efficiency, $\eta_t$, of a single stage impulse turbine as a function of off-design speed through a trial-and-error solution of inlet turbine pressure. At design speed, turbine inlet conditions such as pressure and temperature are assumed as indicated at 54 in software module 42. For instance, turbine inlet conditions may be assumed to be 1000° F., 1000 psia, and exhaust pressure is 15 psia.

The partial-admission efficiency relation, known to those of skill in the art, can be written:

$$\eta_t = \frac{1 + K\left(1 - \frac{s}{a}\right)}{1 + K}\eta_u - \frac{fP\eta_n}{\sin\alpha}\left(\frac{U}{c_1}\right)^3\left(\frac{C}{s}\right)\left(\frac{s}{a}\right) \tag{1}$$

where

K=rotor velocity ratio

C=rotor disk width s=rotor blade spacing a=nozzle arc width f=mixing flow coefficient P=leakage factor $\eta_u$=full-admission turbine efficiency U=turbine blade velocity $C_1$=theoretical spouting velocity at nozzle exit α=nozzle angle $\eta_n$=nozzle efficiency The turbine efficiency, $\eta_t$, as indicated at 56, can also be expressed:

$$\eta_t = \frac{GHP}{\Delta h_s w} \tag{2}$$

where w is the steam flow rate, $\Delta h_s$ is the isentropic change in enthalpy across the turbine as indicated at 58, and GHP is the gross horsepower, which is equal to the sum of the shaft horsepower, accessory horsepower, and condensate pump horsepower.

Using perfect gas relationships $\Delta h_s$ and w can be expressed in the following way:

$$\Delta h_s = c_p T_o \left[1 - \left(\frac{p}{p_o}\right)^{\frac{k-1}{k}}\right] \tag{3}$$

where $T_o$=turbine inlet temperature $p_o$=turbine inlet pressure p=ambient pressure $c_p$=specific heat at constant pressure k=ratio of specific heats for the working fluid and $$w = A_t P_o g \frac{\sqrt{k\left(\frac{2}{k+1}\right)^{\frac{k+1}{k+1}}}}{\sqrt{gkRT_o}} \tag{4}$$

where $A_t$=nozzle throat area g=gravitational acceleration

R=gas constant

It is also assumed that the turbine speed, N, is directly proportional to the vehicular speed, that is:

$$N=mV \tag{5}$$

where m=constant of proportionality

V=vehicular speed

The theoretical spouting velocity is written:

$$c_1=\sqrt{2g\Delta h_s} \tag{6}$$

Knowing the rotor blade diameter, the velocity ratio $U/c_1$ can be calculated.

Thus, through a trail-and-error solution, as indicated at test and loop sequence 60, 62, 64, 66, 68, the off-design inlet turbine pressure based on the above equations, $\eta_t$ as a function of the ratio of off-design vehicular speed over design vehicular speed ($V/V_D$) can be obtained. It is assumed that a partial admission turbine of this general size and type would have its peak efficiency at a velocity ratio of approximately 0.35 as indicated at 69, 70 and 71. If the off-design parameters are out of the range for consideration as indicated at 73, then the subroutine ends as indicated at 75.

In a preferred embodiment of the invention, a determination of propellant consumption rate at off-design speed may be made as indicated 74. In order to determine the propellant consumption rate as a function of vehicular speed, the initial amount of lithium and $SF_6$ as indicated at 78 has to be determined from predefined design parameters such as speed and range as indicated at input box 76.

The steam flow rate required through the turbine is dependent upon the thermodynamic conditions existing across it. At design speed, where the turbine inlet conditions are 1000° F., 1000 psia, and exhaust pressure is 15 psia, the isentropic change in enthalpy is:

$$\Delta h = 1505.1 - 1082.0 = 423.1\frac{btu}{lbm} \tag{7}$$

The design steam flow rate, as indicated at 80, can be calculated from equation (2):

$$w = \frac{GHP_D}{\Delta h_s \eta_{tD}} \tag{8}$$

where $GHP_D$ and $\eta_{tD}$ are the gross horsepower and turbine efficiency at design speed, respectively.

The gross horsepower at design speed is calculated, as indicated at 82, by summing the propulsive power, and estimating the accessory load and the condensate power needs. The condensate pump horsepower, PHP, is given by:

$$PHP = \frac{w\Delta p}{\rho\eta_p} \tag{9}$$

where

Δp=the pressure difference across the pump (equal to turbine inlet pressure plus a friction loss in the boiler tubing minus condenser pressure)

ρ=water density $\eta_p$=pump efficiency≈0.66

NOTE: The friction loss in the boiler tubing was assumed to be 300 psia.

The necessary heat transfer rate to the working fluid is:

$$Q=w\Delta h_b \tag{10}$$

where $\Delta h_b$ is the boiler enthalpy change.

The energy released per pound of reactants, assuming 1300° F. products, is approximately 5600 Btu/lb. Assuming 95% reaction efficiency, the required quantity of reactants is:

$$W_p = \frac{Qt}{(0.95)(5600)} \tag{11}$$

where $W_p$=weight of lithium and $SF_6$ t=desired run time

For off-design speeds, the steam flow rate is determined in the following manner. The turbine efficiency for the desired off-design speed is obtained by the method explained previously. Using the above equations, the necessary turbine inlet pressure is obtained by a trial-and-error solution and the appropriate steam flow rate is thus determined.

Since the boiler discharge temperature is assumed to be approximately constant, the difference between $\Delta h_b$ at design speed and $\Delta h_b$ at off-design speed is small enough to be neglected. The propellant consumption rate, $W_p$, is given by:

$$W_p = \frac{\Delta h_b}{(5600)(0.95)}(w) \tag{12}$$

Knowing $\Delta h_b$ at design speed, $w_p$ is only a function of w.

This procedure can be used as a subroutine to determine the amount of lithium and $SF_6$ used after some designated time increment, as indicated at 86. It should be pointed out that steady-state and not transient conditions are considered. As an example, if the main computer program contained the velocity vs. time profile of the torpedo, i.e., the graph 24 shown in FIG. 2, the subroutine could be used to estimate fuel consumption for each leg and if exhaustion of lithium and $SF_6$ occurs during that leg.

In summary, off-design characteristics are input into main routine 30 at input box 53 and may comprise velocity/time information as indicated in FIG. 2. For each leg of a proposed new route for a vehicle powered by a closed cycle thermal propulsion system, main routine 30 calls subroutine 50. During the first iteration, design characteristics such as design steam flow rate and available fuel are calculated using module 38. After the first iteration, it is not necessary to calculate this information. Module 42 utilizes an iterative technique to calculate off-design performance such as off-design turbine efficiency and off-design steam flow rates. This information may then be utilized to determine fuel consumption rates for off-design parameters. For instances, given a proposed route for a torpedo having a plurality of legs with each leg at a different off-design speed and for a determined time period, the present invention can determine if sufficient fuel is available to complete the proposed route. Thus, one significant advantage of the present invention is that knowing the velocity vs. time profile of the torpedo, one can determine when exhaustion of lithium and $SF_6$ occurs. The present invention can also be used for making performance estimations for off-design vehicle configurations of variable length and diameter.

While the program can be implemented using a general purpose computer programmed, it will be understood for purposes of this application that a computer may also comprise a microprocessor, a programmable integrated circuit, a microcomputer, processor, or any suitable programmable computer. It will be appreciated by those skilled in the art that the invention could also be implemented with special purpose hardware, with program routines or logical circuit sets performing as processors. Such routines or logical circuit sets which may also be referred to as processors or the like.

Therefore, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method for determining one or more off-design performance characteristics for a vehicle powered by a closed cycle thermal propulsion system, said method comprising:

providing design characteristics of said closed cycle thermal propulsion system;

inputting off-design requirements for said closed cycle thermal propulsion system, wherein said off-design requirements comprise one or more curve segments of a selected speed-versus-time plot of a run for a vehicle powered by closed cycle thermal propulsion system, and providing a speed and a time duration for each of said one or more curve segments; and determining said one or more off-design performance characteristic of said closed cycle thermal propulsion system in response to said off-design requirements.

2. The method of claim 1, further comprising determining propellant consumption for said one or more curve segments.

3. The method of claim 2, wherein a different speed is utilized for each of at least two curve segments.

4. A method for determining one or more off-design performance characteristics for a closed cycle thermal propulsion system, said method comprising:

providing design characteristics of said closed cycle thermal propulsion system;

inputting off-design requirements comprising one or more curve segments of a selected speed-versus-time plot of a run for a vehicle powered by said closed cycle thermal propulsion system, and providing an off-design speed and a time duration for each of said one or more curve segments; and determining said one or more off-design performance characteristics of said closed cycle thermal propulsion system in response to said off-design requirements.

5. The method of claim 4, further comprising determining propellant consumption for said one or more curve segments.

6. The method of claim 5 wherein a different off-design speed is utilized for each of at least two curve segments.

* * * * *